US005511981A

United States Patent [19]

Olsen

[11] Patent Number: 5,511,981

[45] **Date of Patent: *Apr. 30, 1996**

[54] PSYCHOLOGICAL OR PSYCHIATRIC EVALUATION, COMMUNICATION, AND EDUCATIONAL APPARATUS

[76] Inventor: Rosalyn N. Olsen, 922 Chestwood Ave., Tallahassee, Fla. 32303

[21] Appl. No.: 364,547

[ * ] Notice: The term of this patent shall not extend beyond the expiration date of Pat. No. 5,399,092.

[22] Filed: Dec. 27, 1994

Related U.S. Application Data

[63] Continuation-in-part of Ser. No. 172,531, Dec. 23, 1993, Pat. No. 5,399,092.

[51] Int. Cl.[6] ..... G09F 9/00

[52] U.S. Cl. ..... 434/238; 434/430

[58] Field of Search ..... 434/430, 236, 434/238

[56] References Cited

U.S. PATENT DOCUMENTS

| | | | |
|---|---|---|---|
| 2,918,730 | 12/1959 | Schras | 434/238 |
| 3,691,652 | 9/1972 | Clynes | 434/236 |
| 3,782,009 | 1/1974 | Parnell | 434/238 |
| 4,344,759 | 9/1982 | Albert | 434/430 |
| 4,741,701 | 5/1988 | Kossor | 434/238 |
| 4,795,348 | 1/1989 | Garthwaite | 434/430 |
| 5,040,988 | 8/1991 | Brown | 434/238 |
| 5,131,849 | 7/1992 | Perrero | 434/430 |
| 5,399,092 | 3/1995 | Olsen | 434/238 |

*Primary Examiner*—Paul J. Hirsch
*Attorney, Agent, or Firm*—Carnes, Dora, Dixon

[57] ABSTRACT

An apparatus that aids in the diagnosis and analysis of an individual suffering from a psychological ailment. The apparatus contains a top end and a bottom end wherein the top end represents a manic region and the bottom end represents a depression region. The tip of the manic region is considered a frenzy area while the lower most area of the depression region is considered a suicidal area. Between these two regions are the mild depression region, the normal region, and the mild mania region proceeding in order from bottom to top. Various elements that represent psychological states are provided so that the user can place the elements that represent that person's current state onto the appropriate region.

10 Claims, 2 Drawing Sheets

PSYCHOLOGICAL OR PSYCHIATRIC EVALUATION, COMMUNICATION, AND EDUCATIONAL APPARATUS

This is a Continuation-in-part of application Ser. No. 08/172,531, Dec. 23, 1993, now U.S. Pat. No. 5,399,092.

BACKGROUND OF THE INVENTION

Many individual suffer from some form of psychological or psychiatric problem. Few of these individuals will seek professional help, and those that do, face many obstacles. One such obstacle is communication between the individual sufferer and the mental health professional. Typically, the individual seeking help will be asked a series of questions about the person's thoughts and feelings. These questions will be presented either on a paper questionnaire or will be asked by a staff member who will record the responses offered. The mental health provider will then process the answers received, in order to paint a picture of the individual's mental health state. From this picture, the provider will make a diagnosis and thereafter will prescribe a course of treatment. This mental provider-consumer communication suffers twin short-comings.

An individual suffering from a mental health affliction may not be able to express thoughts and feelings through questions and answers. The individual may know what he or she is thinking or feeling but may not be able to express this verbally. Or the person may find such question cold and intrusive and may not wish to answer them, and may offer any answer just to be left alone.

The result is a communication breakdown with the message sent from consumer to provider being blocked or distorted. A course of treatment will be difficult to embark upon and if it is embarked upon, it will be distorted.

A second problem results in interpretation of the resulting answers by the provider. Even if the individual clearly answered all questions, the provider will require a frame work or criteria in order to assemble a mental health picture of the individual. Any picture so assembled will not necessarily be complete. Holes in the picture will be filled in during the course of treatment resulting in a refinement of the treatment as more of the picture comes into view. Such a course will not be an efficient use of resources and can even be counter-productive.

What is needed is an apparatus that will permit an individual to express his or her thoughts and feelings without the necessity of resorting to verbal semantics. Such an apparatus must permit effective communication and must be relatively simple to use. Further more, such an apparatus must permit the mental health provider to make a comprehensive diagnosis and evaluation of a persons mental health state quickly so that an appropriate course of treatment may be commenced.

SUMMARY OF THE INVENTION

The present invention provides for an apparatus that will help in the diagnosis and evaluation of an individual suffering from any psychological or psychiatric problem, such as depression or a mood disorder. This is accomplished by providing a device wherein the individual suffering from the psychological or psychiatric problem expresses his or her feelings in a visual manner. Once these feelings are visually displayed, the mental health provider will be able to make a rapid and accurate evaluation of the individual's psychological or psychiatric state. The use of visual devices promotes and assists effective communication among the various individuals involved in the diagnostic, evaluation, and treatment processes associated with mental health treatment. These individuals include the person seeking treatment, the person's family, doctors, social workers, counselors, psychologists, etc.

The apparatus of the present invention consists of a structure, having a distinct base and a distinct top end. The overall structure is divided into several regions or areas. The top area of the structure is the mania or high region, the middle area is the "okay" region, and the bottom area is the depression or low region. Located just above the okay region and just below the mania region is a mild mania area. Located just below the okay region and just above the depression area is the mild depression area. This arrangement will provide for the mild mania area and the mild depression area to sandwich the normal area or "okay" region.

Various elements are adapted to be attachably secured to the structure of the present invention. These various elements include indicators, representatives and a mixed state. These indicators are various symptoms that can lead the viewer to a sense of what the individual is experiencing or feeling. The representatives are diagnoses which may be rooted in a mood disorder. The mixed state occurs when symptoms and/or feelings are experienced continuously or are rapidly alternating.

Another element that can be used is an amplifier. This amplifier, like the other elements, is adapted to be removably secured to the main base. The amplifier is a device that is designed to surround an indicator. Utilizing the amplifier provides a visual means for illustrating and displaying a particular symptom that is augmented by enabling an individual to place the amplifier around the particular symptom.

In order to utilize the apparatus, one would merely place the indicators and/or the representative(s) on the appropriate regions or areas on the structure (i.e. mania, mixed state, depression, mild mania, mild depression) to correlate with the individuals feelings and the degree thereof. Due to the unique interaction between the apparatus of the present invention and the client, the individual will be able to express, clarify, and acknowledge his or her condition.

Once the indicators and/or representative(s) are properly placed on the structure, the mental health provider will have a comprehensive visual picture of the individuals mental health state. From this picture, an appropriate treatment plan can be devised and embarked upon.

Accordingly, it is the object of the present invention to provide for a psychological or psychiatric evaluation and communication apparatus that is completely individualized.

It is another object of the present invention to provide for a psychological or psychiatric evaluation and communication apparatus that is easy to use and operate.

It is a further object of the present invention to provide for a psychological or psychiatric evaluation and communication apparatus that is a visual aid and can promote communication and discussion between the various individuals involved with mental health treatment including the client, doctor, social worker, counselor, psychiatrist, family members, etc.

Still a further object of the present invention to provide for a psychological or psychiatric evaluation and communication apparatus that will provide for the individual suffering from a psychological or psychiatric problem to be able to identify his or her feelings.

Yet another object of the present invention to provide for a psychological or psychiatric evaluation and communication apparatus that will monitor the progress of an individual who is in treatment for a psychological or psychiatric problem.

Yet a further object of the present invention to provide for a psychological or psychiatric evaluation and communication apparatus that will be utilized as an education tool.

A final object of the present invention, to be specifically enumerated herein, is to provide a psychological or psychiatric evaluation and communication apparatus in accordance with the preceding objects and which will conform to conventional forms of manufacture, be of simple construction and easy to use so as to provide a device that would be economically feasible, long lasting and relatively trouble free in operation.

Although there have been few inventions related to psychological or psychiatric evaluation and communication apparatus, none of the inventions have become sufficiently compact, low cost, and reliable enough to become commonly used. The present invention meets the requirements of the simplified design, compact size, low initial cost, low operating cost, ease of portability and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
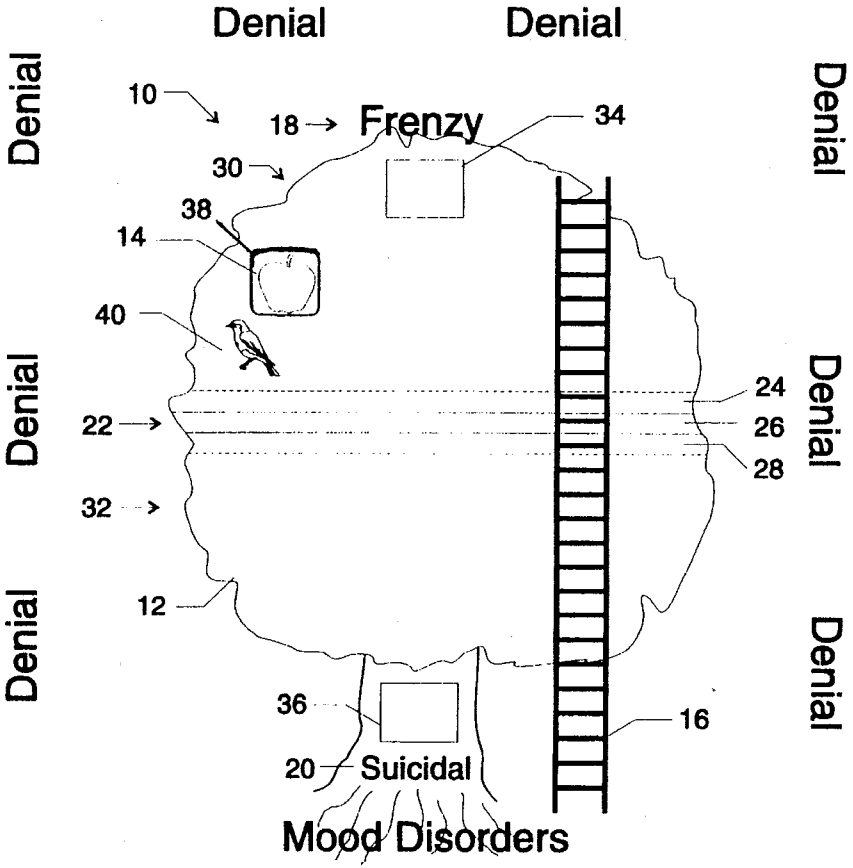
FIG. 1 is a front elevational view of one type of the psychological or psychiatric evaluation and communication apparatus of the present invention.

Referring now in detail to the drawings, FIG. 1 illustrates a front view of the psychological or psychiatric evaluation and communication apparatus 10 of the present invention. As seen in this figure, the main structure 12, illustrated as an apple tree in this figure, contains a variety of elements. Indicators 14 are the first set of elements and are represented as apples in this figure. The second element is the mixed state 16, which is represented in this figure as a ladder.

As FIG. 1 illustrates, the main structure 12 is divided into several sections. The top, or uppermost area 18 of the main structure is considered frenzy. While at the bottom, or lowermost area 20 of the main structure 12 is considered suicidal.

The middle area 22, is divided into three regions. The first region 24 is mild mania. Mild mania is a mood disturbance which is not severe and does not cause the individual marked impairment in social or occupational functioning and does not require hospitalization.

Located directly below mild mania is the "Okay" or normal state 26, wherein the individual experiences normal mood swings which are manageable with reason and time. It is at this state where the majority of today's population exist.

The final or third region 28 of the middle area 22 is mild depression. Mild depression is a mood disturbance which is not severe and does not cause the individual marked impairment in social or occupational functioning and does not require hospitalization.

The section directly above the first region 24 of the middle area 22 is the mania area 30, while the section directly below the third region 28 of the middle area 22 is the depression area 32.

At the top portion of the main structure 12 of the psychological or psychiatric evaluation apparatus 10 is another element which is a means 34 of representing the phrase or term "self importance", "all self", or "omnipotence". In this figure, the means is a block that is labeled "self importance", "all self", or "omnipotence". This means or block signifies the typical feelings of an individual suffering from mania. It is noted that this means or block 34 that represents "self importance", "all self", or "omnipotence" is not limited to this shape or any particular size and can include any design.

In this "self importance", "all self", or "omnipotence" stage characteristically, one experiences an inflated self-esteem, ranging from uncritical self-confidence to marked grandiosity, which may be delusional.

It is noted that from the "okay" or normal state 26 the psychological or psychiatric evaluation becomes gradually more serious as the symptoms are moved upwards, towards the uppermost area (frenzy region 18) of the main structure.

Located at the bottom portion of the main structure 12 of the psychological or psychiatric evaluation apparatus 10 is another element which is a means 36 that represents the feeling of "no self" or "total worthlessness". This means in this figure is represented by a block which is labeled "no self" or "total worthlessness". It is noted that this means or block 36 that represents "no self" or "total worthlessness" is not limited to this shape or any particular size and can include any design.

In this "no self" or "total worthlessness" stage characteristically, one experiences a sense of incompetence which varies from feelings of inadequacy to completely unrealistic negative evaluations of one's worth.

It is noted that from the "okay" or normal state 26 the psychological or psychiatric evaluation becomes gradually more serious as the symptoms are moved downwards, towards the lowermost area (suicidal region 20) of the main structure.

When an individual is suffering from mania, he or she will usually experience a predominant mood which is either elevated (euphoria, area in the proximity of the "all self" representation), expansive (centrally located on the mania area), or irritable (frenzy area, right on the tip of the main structure). Further, typical symptoms are present when one is manic. These symptoms can include, but not be limited to, inflated self-esteem or grandiosity (which may be delusional), decreased need for sleep, pressure of speech, flight of ideas, distractibility, increased involvement in goal-directed activity, psychomotor agitation, and excessive involvement in pleasurable activities which have a high potential for painful consequences that the person often does not recognize. Additionally, a person who is manic often does not recognized that he or she is ill and avoids and resist all efforts of treatment.

When an individual is suffering from depression, he or she will usually be either in a depressed mood or experience loss of interest or pleasure in all, or almost all, activities and associated symptoms for a period of at least two weeks. The associated symptoms may include, but not be limited to, appetite disturbance, change in weight, sleep disturbance, psychomotor agitation or retardation, decreased energy, feelings of worthlessness or excessive or inappropriate guilt, difficulty thinking or concentrating, and recurrent thoughts of death or suicidal ideation or attempts. Further, a person suffering from depression can also experience anxiety, irritability, brooding or obsessive rumination, excessive concern with physical health, panic attacks, and phobias.

The indicators 14 represent the various symptoms and features that can lead to a sense of what the person is experiencing or feeling. The indicators are illustrated as apples in this figure. The various indicators can include, but not be limited to the following: low self-esteem, can't stand pressures, money issues, anxiety, poor judgment, migraine headaches, alcohol or drug use, bad temper, gastric problems, sleep disturbance, low energy, hopeless, crying, helplessness, suicidal thoughts, poor memory, can't make decisions, indifference, blackouts, poor hygiene, overeating, aches and pains, phobias, poor concentration, high energy, power issues, shopping sprees, lots of laughing, feeling smart, no meds (medication) for me, gastro-intestinal problems, grandiosity, fast talking, fast thoughts, high sex, no appetite, confusion, agitation, guilt, disgust, reckless behavior, argumentative, urge to violence, hostility, impulsive, aggressivè, apathy, and homicidal feeling. Additionally, several elements representing the indicators can be left blank in order to provide for the individual to write in his or her own personal feelings or symptoms that were not indicated above. This will provide for a list of symptoms that can be added to or changed.

Representatives 40, another element, can be provided on the main structure 12. These representatives are diagnoses which may be rooted in a mood disorder and may appear on any region or area of the psychological or psychiatric evaluation and communication apparatus 10. This representative are adapted to be removably secured to the main structure 12 and as such may disappear as a patient is improving during treatment. The representatives can include the following diagnoses, but not be limited to, paranoia, psychosis, confusion and anxiety. These representatives are designed to correspond with the shape of the main structure.

An amplifier 38 is another element that is used on the main structure 12. This amplifier is adapted to be removably secured to the main structure. As illustrated, the amplifier is so designed and structured to outline the indicators 14. The amplifier provides the user a means of expressing or illustrating a particular symptom that is strongly experienced by enabling the individual to place the amplifier 38 around that particular symptom.

Denial is a classic characteristic of an individual suffering from a psychological or psychiatric problem or mood disorder. In order to represent the classic and common characteristic, the word "DENIAL" surrounds the structure.

The main structure and the variety of elements that make up the present invention can take on a variety of shapes, structure, and design. For the main structure 12, any conventional or standard structure having various heights and elevations can be used or substituted for the main structure of the psychological or psychiatric evaluation and communication apparatus. For example a building, pine tree, or any fruit or nut bearing tree, etc., can be used to illustrate the main structure. The main features that the main structure must possess are a distinct base and a distinct top end. In addition, the structure may include a slight color variation from the top end to the base. For example, the top end can be of a yellow tone and gradually change to a blue tone, which will be located at the base.

The indicators are elements that correspond to the main structure. Accordingly, any fruit or nut (i.e. oranges, lemons, walnuts, etc.) can be used to portray the various mood disorders when a fruit or nut bearing tree is the main structure. As is illustrated in the following figures, the main structure is a tree and the indicators are apples. Another example (not illustrated) is to provide for a building to be used as the main structure, then windows can be used for the representation of the indicators. Yet another example is if a pine tree is used as the main structure, then pine cones can be utilized for the various indicators.

As stated previously, the mixed state 16 is not limited to a ladder. Additional types of elements can be used for the depiction of this state in order to correspond to the main structure. For example, if a building is the main structure, then an elevator system can be used as the mixed state. The element representing the mixed state is adapted to be removably secured to the main structure.

The representatives also are used to correspond to the main structure and the other elements. In this example birds are used to represent these diagnoses.

Figure 2:
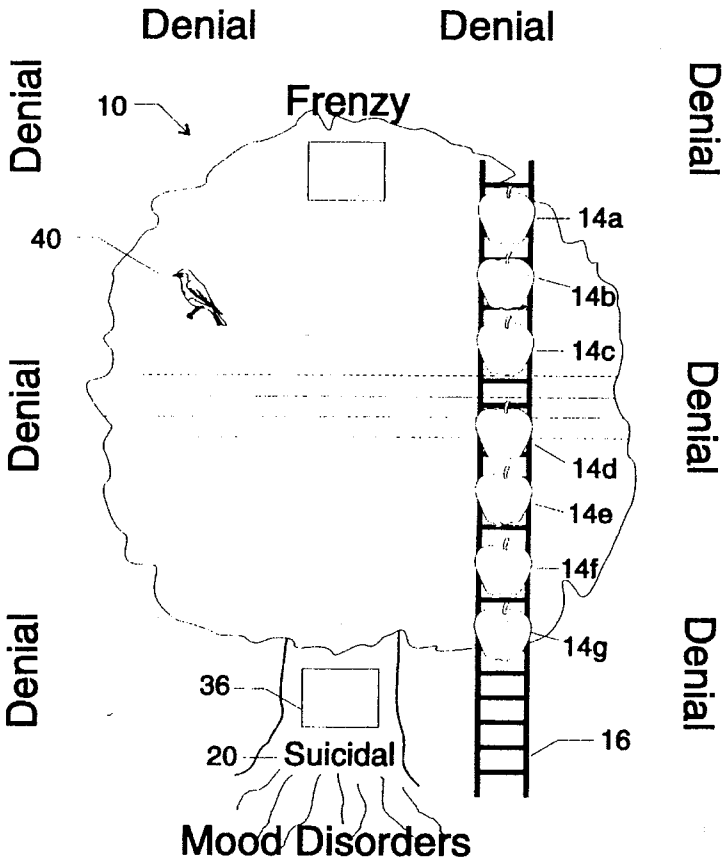
FIG. 2 is an example of a mixed state disorder evaluation provided by the use of the psychological or psychiatric evaluation and communication apparatus of the present invention.

In order to do a psychological or psychiatric evaluation on the psychological or psychiatric evaluation and communication apparatus 10, one would merely place the appropriate elements (indicators, representatives and/or amplifier) on the main structure 12. An example of a clinically typical mixed state is illustrated in FIG. 2, wherein an apple tree is utilized as the main structure and apples represent the various indicators. As seen in this figure, the subject placed the following indicators: fast thoughts **14*a*, power issues 14*b*, sleep disturbance 14*c*, hopelessness 14*d*, crying 14*e*, low energy 14*f*, and helplessness 14*g* all on the mixed state 16 (which is illustrated as a ladder in this example) in order to identify and express the symptoms and/or feelings he or she was experiencing. The reason why the subject placed his or her indicators on the mixed state is because he or she would experience these symptoms or feelings listed on the indicators at all times or they would occur rapidly cycling up and down. As also illustrated in this example, the subject placed a representative on the main structure 12. This representative represents paranoia 40** which identifies what the client was experiencing. The doctor, counselor, social worker, etc., could clearly analyze the subject and treat him or her with the appropriate care. Additionally, the subject is also able to clearly see and analyze his or her own condition.

Figure 3:
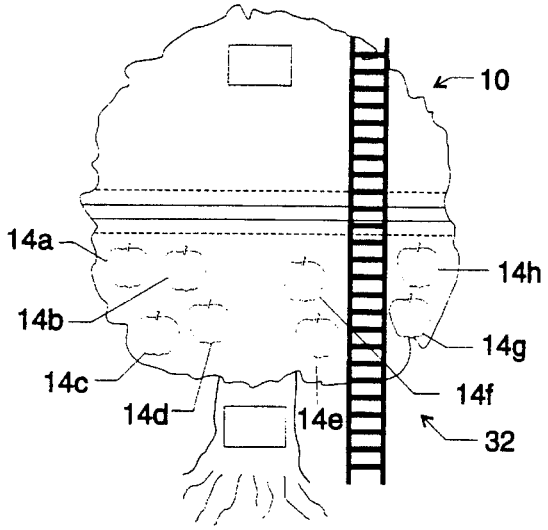
FIG. 3 is an example of a depression disorder evaluation provided by the use of the psychological or psychiatric evaluation and communication apparatus of the present invention.

An example of a clinically typical subject suffering from depression is illustrated in FIG. 3, wherein an apple tree is utilized as the main structure and apples represent the various indicators. As shown in this figure, the subject placed the following indicators: helpless 14*a*, sleep disturbance 14*b*, crying 14*c*, low energy 14*d*, poor judgment 14*e*, poor memory 14*f*, can't stand pressure 14*g*, and suicidal thoughts 14*h* all below the middle region in the depression area 32. These indicators 14*a*–14*h* were placed in the depression area by the subject in order to identify the symptoms and feelings he or she was experiencing. The doctor, counselor, social worker, etc., could clearly analyze the subject and treat him or her with the appropriate care. Additionally, the subject is also able to clearly see and analyze his or her own condition.

Figure 4:
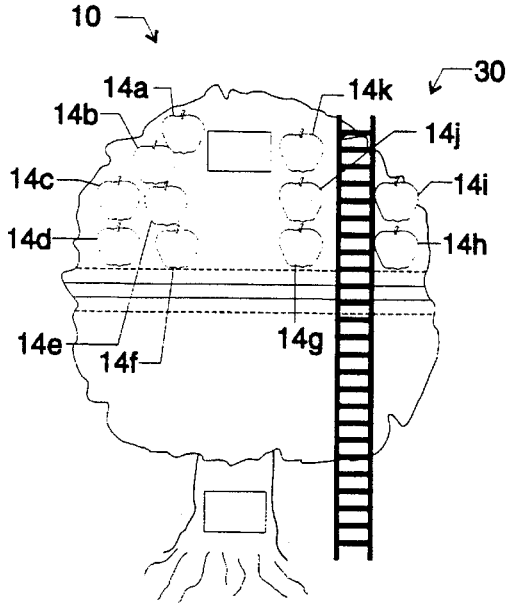
FIG. 4 is an example of a manic disorder evaluation provided by the use of the psychological or psychiatric evaluation and communication apparatus of the present invention.

An example of a clinically typical subject suffering from mania is illustrated in FIG. 4 wherein an apple tree is utilized as the main structure and apples represent the various indicators. As shown in this figure, the subject placed the following indicators: high energy 14*a*, bad temper 14*b*, lots of laughing 14*c*, poor judgment 14*d*, alcohol or drug use 14*e*, power issues 14*f*, sleep disturbance 14*g*, shopping sprees 14*h*, gastro-intestinal problems 14*i*, money issues 14*j*, and can't stand pressure 14*k* all above the middle region in the mania area 30. These indicators 14*a*, 14*k* were placed in the mania area by the subject in order to identify the symptoms and feelings he or she was experiencing. The doctor, counselor, social worker, etc., could clearly analyze the subject and treat him or her with the appropriate care. Further, the subject is also able to clearly see and analyze his or her own condition.

The main structure, illustrated in FIGS. 1–4 can be fabricated from any type of material, such as metal, felt cardboard, flannel, etc. Further, the structure can include any size, shape or design. For example, the main structure may be permanently attached to an easel-like support. The easel-like support can vary in size, from being extremely large, in order to be used in an auditorium, to being smaller and portable, in order to be used on a table or desk. Additionally, the main structure can be permanently attached to any type of material. This material can then be affixed by an attachment mean (tape, thumb tacks, VELCRO, etc.) to any display device (black board, bulletin board, etc.).

The psychological or psychiatric apparatus may also be provided with a tray (not illustrated) below the bottom area, in order to store the indicators and banners.

The indicators, representatives, and mixed state are attachable and detachable from the main structure. The material used for the indicator, representatives, and mixed state should correspond with the main structure. For example, if the main structure is made of metal, then the elements (indicators, representatives, and mixed state) are fabricated from a magnetic material. A second example is if the main structure is made of flannel, then the elements would be fabricated from felt.

The various regions (mild mania, normal state, mild depression, depression, and mania) are permanently indicated and are accompanied with the appropriate illustrated heading or title.

Figure 5:
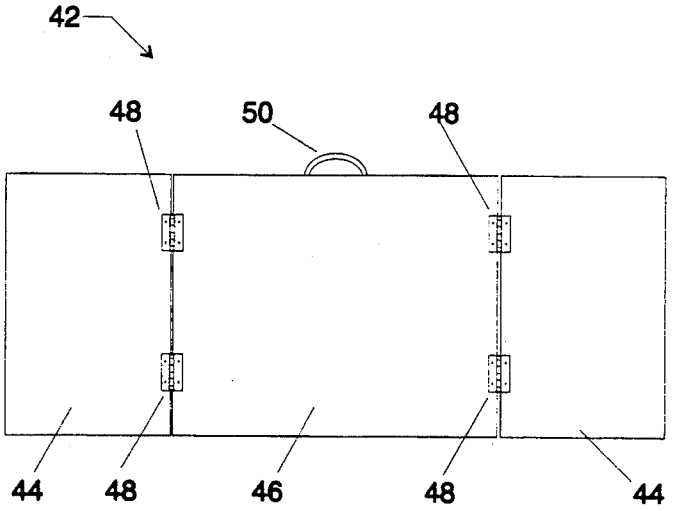
FIG. 5 is a front elevational view of one type of a storage and displayed device for the various indicators and representatives in accordance with the present invention.

An example of a display and storage case for the indicators is illustrate in FIG. 5. As seen in this figure, there is shown a display and storage case 42 which has two side doors 44. The doors are attached to a main frame 46 by the use of hinges 48. The hinges provide the doors to open and close freely. Located on the doors is a conventional locking means (not illustrated). This locking means provides the doors to be securely and safely fastened when the case is not being utilized. Located on the top area of the main frame is an optional handle 50 which will provide a easy means for carrying the case. The handle may also be placed on the side of the storage case.

However, it is noted that the display and storage case is not limited to the shape and design as illustrated in FIG. 5. The display and storage case can be of any shape, style, design or size.

While the invention has been particularly shown and described with reference to an embodiment thereof, it will be understood by those skilled in the art that various changes in form and detail may be made without departing from the spirit and scope of the invention.

I claim:

1. A psychological or psychiatric evaluation apparatus comprising:

a first structure, forming a main structure, has a top area, a middle area, and a bottom area and said middle area being substantially smaller than said top area and said bottom area;

said top area includes a mania region, said bottom area includes a depression region, and said middle area includes a mild mania region located below said mania region and a mild depression area located above said bottom area, and a normal region sandwich therebetween;

a first visual marking means divides said mild mania region from said normal region;

a second visual marking means divides said mild depression region from said normal region;

a third visual marking means divides said mild mania region from said mania region;

a fourth visual marking means divides said mild depression region from said depression region;

a second structure;

said second structure is attached to said first structure;

said second structure extends across a portion of said mania region, said mild mania region, said normal region, said mild depression region, and said depression region;

said second structure being substantially thinner than said first structure;

said second structure represents a mixed state region;

a plurality of indicators;

said indicators are adapted to being removably secured to said first structure and said second structure;

said indicators represent a variety of symptoms which are experienced from one suffering from a mood disorder;

a plurality of representatives;

said representatives being adapted to being removably secured to said first structure or said second structure; and said representatives represent a variety of diagnoses.

2. A psychological or psychiatric evaluation apparatus as in claim 1 wherein said main structure includes a top end and said top end includes a first symbol and said main structure includes a base and said base includes a second symbol;

said first symbol visually represents an omnipotence state and said second symbol visually represents a no-self state.

3. A psychological or psychiatric evaluation apparatus as in claim 2 wherein said base of said first structure includes a suicidal region and located above said top end of said main structure is a frenzy region.

4. A psychological or psychiatric evaluation apparatus as in claim 1 wherein said main structure is a tree, said indicators are in the shape of apples, oranges, peaches, pears, bananas, apricots, grapefruits, coconuts, walnuts, acorns, pecans, cashews, almonds, or chestnuts, and said representatives are shaped like birds, and said second structure is a ladder.

5. A psychological or psychiatric evaluation apparatus as in claim 1 wherein said first structure is a building, said indicators are in the shape of windows and said second structure is an elevator system.

6. A psychological or psychiatric evaluation apparatus as in claim 1 wherein said second structure is permanently attached to said main structure.

7. A psychological or psychiatric evaluation apparatus as in claim 1 wherein said second structure is adapted to be removably secured to said main structure.

8. A psychological or psychiatric evaluation apparatus as in claim 1 wherein a second set of indicators are adapted to be removably secured to said main structure and said second set of indicators are blank to permit for a user to write in a symptom.

9. A psychological or psychiatric evaluation apparatus as in claim 1 wherein a border is located around said first structure and said border represents denial.

10. A psychological or psychiatric evaluation apparatus as in claim 1 wherein at least one amplifier is adapted to be removably secured around at least one indicator.

* * * * *